US009856113B2

(12) United States Patent
Lehtinen et al.

(10) Patent No.: US 9,856,113 B2
(45) Date of Patent: Jan. 2, 2018

(54) ELEVATOR

(71) Applicant: KONE Corporation, Helsinki (FI)

(72) Inventors: Hannu Lehtinen, Numminen (FI); Jussi Perälä, Hyvinkää (FI); Raimo Pelto-Huikko, Vantaa (FI); Juha Helenius, Vantaa (FI)

(73) Assignee: KONE CORPORATION, Helsinki (FI)

( * ) Notice: Subject to any disclaimer, the term of this patent is extended or adjusted under 35 U.S.C. 154(b) by 48 days.

(21) Appl. No.: 14/803,838

(22) Filed: Jul. 20, 2015

(65) Prior Publication Data

US 2016/0039638 A1 Feb. 11, 2016

(30) Foreign Application Priority Data

Aug. 11, 2014 (EP) ..... 14180503

(51) Int. Cl.
*B66B 7/06* (2006.01)
*B66B 11/00* (2006.01)
*B66B 9/00* (2006.01)

(52) U.S. Cl.
CPC ..... *B66B 7/06* (2013.01); *B66B 7/062* (2013.01); *B66B 9/00* (2013.01); *B66B 11/008* (2013.01)

(58) Field of Classification Search
CPC ..... B66B 7/06; B66B 7/062; B66B 11/0065; B66B 11/008; B66B 11/0095
See application file for complete search history.

(56) References Cited

U.S. PATENT DOCUMENTS 360,027 A * 3/1887 Lawlor ..... B66B 11/008 187/263
5,076,398 A * 12/1991 Heikkinen ..... B66B 11/08 187/266

(Continued)

FOREIGN PATENT DOCUMENTS

CN 1469838 A 1/2004
CN 1545479 A 11/2004

(Continued)

*Primary Examiner* — Minh Truong
(74) *Attorney, Agent, or Firm* — Birch, Stewart, Kolasch & Birch, LLP

(57) ABSTRACT

An elevator includes a first elevator unit vertically movable in a hoistway; a second elevator unit vertically movable in a hoistway; a suspension roping including one or more belt-shaped suspension ropes interconnecting the first elevator unit and the second elevator unit; a drive wheel for moving said one or more belt-shaped suspension ropes; a plurality of cambered diverting wheels; said one or more belt-shaped suspension ropes each passing around the drive wheel and comprising consecutively a first rope section extending between the drive wheel and the first elevator unit; and a second rope section extending between the drive wheel and the second elevator unit wherein both rope sections diverge from the drive wheel towards the same lateral side thereof, the first rope section passing over a first cambered diverting wheel, in particular resting against a cambered circumferential surface area thereof, and therefrom down to the first elevator unit, and the second rope section passing over a second cambered diverting wheel, in particular resting against cambered circumferential surface area thereof, and therefrom down to the second elevator unit.

8 Claims, 3 Drawing Sheets

(56) References Cited

U.S. PATENT DOCUMENTS

| | | | | |
|---|---|---|---|---|
| 5,361,873 | A * | 11/1994 | de Jong | B66B 15/04 187/264 |
| 6,006,865 | A * | 12/1999 | Ammon | B66B 11/0045 187/266 |
| 6,193,017 | B1 * | 2/2001 | Koster | B66B 7/10 187/256 |
| 7,543,685 | B2 * | 6/2009 | Ach | B66B 11/004 187/250 |
| 8,793,939 | B2 * | 8/2014 | Landry | B66B 19/005 187/213 |
| 2004/0108170 | A1 * | 6/2004 | Kocher | B66B 7/021 187/254 |
| 2004/0206580 | A1 * | 10/2004 | Ishii | B66B 7/021 187/264 |
| 2007/0062762 | A1 * | 3/2007 | Ach | B66B 7/062 187/266 |
| 2008/0099285 | A1 * | 5/2008 | Det | B66B 7/027 187/406 |
| 2010/0133046 | A1 * | 6/2010 | Allwardt | B66B 7/08 187/251 |
| 2013/0206516 | A1 | 8/2013 | Pelto-Huikko et al. | |
| 2014/0182976 | A1 * | 7/2014 | Valjus | B66B 7/062 187/254 |

FOREIGN PATENT DOCUMENTS

| | | | |
|---|---|---|---|
| CN | 201224439 | Y | 4/2009 |
| CN | 103287947 | A | 9/2013 |
| DE | 10 2008 037 538 | A1 | 5/2010 |
| EP | 1 431 231 | A | 6/2004 |
| EP | 1 451 090 | | 9/2004 |
| EP | 1 514 827 | A1 | 3/2005 |
| FI | 122261 | B | 11/2011 |
| JP | 2004-1919 | A | 1/2004 |
| WO | 03/031310 | A1 | 4/2003 |
| WO | WO 03/048020 | A1 | 6/2003 |
| WO | WO 2009/090299 | A1 | 7/2009 |

* cited by examiner

ELEVATOR

FIELD OF THE INVENTION

The invention relates to an elevator for transporting passengers and/or goods.

BACKGROUND OF THE INVENTION

An elevator typically comprises an elevator car and a counterweight, which are vertically movable in a hoistway. These elevator units are interconnected to each other by a suspension roping that suspends them on opposite sides of a drive wheel. For providing force for moving the suspension roping, and thereby also for the elevator units, the elevator comprises a motor for rotating the drive wheel engaging the suspension roping. The motor is typically automatically controlled by an elevator control system.

The ropes on opposite sides of the drive wheel pass in the hoistway at a certain distance from each other (later referred to as rope-to-rope distance). In elevator design, the rope-to-rope distance cannot be freely chosen. Typically, the rope-to-rope distance is largely defined by the size and position of the movable elevator units, in particular car size and counterweight position in shaft layout. In prior art, one diverting wheel has been added in the system so as to attain more flexibility for the rope-to-rope distance. This kind of arrangement is illustrated in FIG. 1. In this case, on one side of the drive wheel, the rope has passed directly to one of the elevator units and on the other side around said diverting wheel. Thereby, the rope-to-rope distance has been possible to adjust suitable by adjusting lateral position of the diverting wheel.

In elevators, the roping comprises at least one but typically several ropes passing alongside each other. There are elevators where the ropes are belt-shaped, i.e. they have a cross section with width substantially greater than the thickness thereof. Position of the belt-shaped ropes relative to each wheel around which it passes (in the axial direction of the wheel) as well as relative to each other needs to be controlled so that adjacent ropes do not drift too close to each other, and so that none of the ropes drifts in said axial direction away from the circumferential surface area of the wheel against which the rope in question is intended to rest. One way to control this axial position of the belt-shaped ropes is to shape the circumferential surface areas of the wheel cambered. Each cambered circumferential surface area has a convex shape against the peak of which the rope rests. The cambered shape tends to keep the rope passing around it positioned resting against the peak thereof, thereby resisting displacement of the rope away from the point of the peak.

In prior art, a drawback has been that some configurations have been difficult to make utilizing cambered wheels. Particularly, when the rope-to-rope distance needs to be close to but a little wider than drive wheel diameter, the rope control in said axial direction has not worked reliably when utilizing cambered shape for rope position control. In these circumstances, the rope has been noted to be prone to wander in axial direction along the cambered shape. At worst, this behavior could cause the rope to move completely away from the cambered wheel. Therefore, it has been problematic to build a system utilizing cambered shape for rope position control where rope-to-rope distance is wider than but close to the diameter of the drive wheel.

BRIEF DESCRIPTION OF THE INVENTION

The object of the invention is, inter alia, to alleviate previously described drawbacks of known solutions and problems discussed later in the description of the invention. The object of the invention is to introduce an elevator where cambered wheels can be used to provide the suspension ropes with effective position control in axial direction of the wheels yet allowing free selection of the rope-to-rope distance. Embodiments are presented, inter alia, where contact length between ropes and the diverting wheel can be kept adequately long with any rope-to-rope distance, such as when rope-to-rope distance is wider than but close to the diameter of the drive wheel.

It is brought forward a new elevator comprising a first elevator unit vertically movable in a hoistway; a second elevator unit vertically movable in a hoistway; a suspension roping comprising one or more belt-shaped suspension ropes interconnecting the first elevator unit and the second elevator unit; a drive wheel for moving said one or more belt-shaped suspension ropes; a plurality of cambered diverting wheels; said one or more belt-shaped suspension ropes each passing around the drive wheel and comprising consecutively a first rope section extending between the drive wheel and the first elevator unit; and a second rope section extending between the drive wheel and the second elevator unit. Both said rope sections diverge from the drive wheel towards the same lateral side thereof, the first rope section passing over a first cambered diverting wheel, in particular resting against a cambered circumferential surface area thereof, and therefrom down to the first elevator unit, and the second rope section passing over a second cambered diverting wheel, in particular resting against cambered circumferential surface area thereof, and therefrom down to the second elevator unit. One or more of the objects of the invention are facilitated with this configuration. It has been found by experimental work and analyzing that certain minimum contact length between rope and a cambered diverting wheel is required to ensure proper control of rope position in axial direction of the cambered diverting wheel. When the drive wheel has been positioned such relative to diverting wheels that the rope sections of a rope diverge in the defined way from the drive wheel towards the same lateral side thereof, the contact length between rope and the diverter wheel can be without problems be set, with any rope-to-rope distance, to be adequately long to enable the cambered shape to act effectively on the rope. This is realized also when rope-to-rope distance is wider than but close to the diameter of the drive wheel. Thus, with the defined elevator construction also this kind of configuration can be implemented. Another benefit is that effective axial position control can be ensured with both directions of movement of the rope(s). This is because axial rope position has been found to be most meaningfully controlled by the cambered diverting wheel which rope enters first. Each rope section is guided properly, thanks to the adequately long contact length, so with any of the two running directions the rope arriving to the drive wheel is effectively controlled in terms of its position in axial direction.

In a first type of preferred embodiment, the first rope section diverges from the drive wheel obliquely downwards to the first diverting wheel, and the second rope section diverges from the drive wheel obliquely downwards to the second diverting wheel. Thus, a contact length between the ropes and the drive wheel can be kept adequate for most elevators. A long contact length ensures good traction as well as effect of the possible cambered shape between the ropes and the drive wheel. This facilitates also the overall slimness of the wheel configuration.

In a second type of preferred embodiment, one or both of the first and second rope sections diverges from the drive wheel obliquely upwards to a diverting wheel over which the section in question passes, the diverting wheel in question diverting the angle of the ropes substantially more than 90 degrees. Thus, the contact length between the ropes and the diverting wheel in question is strongly increased thereby increasing the effect of the cambered shape of the diverting wheel on the rope. In one embodiment, the first rope section diverges from the drive wheel obliquely upwards to the first cambered diverting wheel, and the second rope section diverges from the drive wheel obliquely downwards to the second cambered diverting wheel. Thus, the contact length between the ropes and the first diverting wheel is strongly increased thereby increasing the effect of the cambered shape of the first diverting wheel on the rope. Thus, also a contact length between the ropes and the drive wheel is maximized. A long contact length ensures good traction as well as effect of the possible cambered shape between the ropes and the drive wheel. This also facilitates making the overall structure for the configuration of wheels low. In another embodiment, the first rope section diverges from the drive wheel obliquely upwards to the first diverting wheel, and the second rope section diverges from the drive wheel obliquely upwards to the second diverting wheel.

Preferably, the first or the second, but preferably both the first cambered diverting wheel and the second cambered diverting wheel are completely at lateral side of the drive wheel. This facilitates making the overall structure for the configuration of wheels low. This also makes easier to arrange one or both of the rope sections to diverge from the drive wheel obliquely upwards to a diverting wheel.

Preferably, said first diverting wheel is at said lateral side closer to the drive wheel than the second diverting wheel. Thus, unobstructed passage of each rope section straight down to an elevator unit from the diverting wheel is facilitated.

Preferably, the distance between the first rope section passing down from the first cambered diverting wheel to the first elevator unit and the second rope section passing down from the second cambered diverting wheel to the second elevator unit is at most, but preferably less than 1.5 times the diameter of the drive wheel. In this context, the defined way of diverging of the rope sections from the drive wheel is particularly beneficial, as in this case long contact length between the diverting wheels and the rope is critical. Thus, an elevator with short rope-to-rope distance can be feasibly provided.

Preferably, one or both of said first and second diverting wheel diverts the angle of the ropes substantially more than 90 degrees. Thus, the contact length between the ropes and the diverting wheel in question is strongly increased, whereby the guiding effect of the cambered shape of the diverting wheel on the rope is ensured.

Preferably, said one or more belt-shaped suspension ropes comprises a plurality of belt-shaped suspension ropes as defined.

Preferably, each of said first and said second diverting wheel comprises a cambered circumferential surface area for each of said one or more ropes against which circumferential surface area the rope in question is arranged to rest.

Preferably, the drive wheel is also cambered, particularly comprising a cambered circumferential surface area for each of said one or more ropes against which circumferential surface area the rope in question is arranged to rest.

Preferably, each of said cambered circumferential surface area has a convex shape having a peak against which one of said one or more ropes rests.

Preferably, said first cambered diverting wheel, said drive wheel, and said second cambered diverting wheel are mounted to rotate at a stationary location, preferably at a stationary location above the elevator units. Preferably, said first cambered diverting wheel, said drive wheel, and said second cambered diverting wheel are mounted on stationary structure(s) of the building, such as on structures of the hoistway or structures of a machine room provided close to, such as above or next to, the hoistway.

Preferably, one of the elevator units is, or at least comprises an elevator car and the second is, or at least comprises a counterweight or a second elevator car.

Preferably, the elevator comprises a motor for rotating the drive wheel and an automatic elevator control for controlling the motor.

Preferably, each cambered circumferential surface area as well as the surface of the rope resting against it is smooth, in particular such that neither of said circumferential surface area nor the rope has protrusions extending into recesses of the other. Thereby, the control of axial position of each rope is provided by the shape of the cambered circumferential surface area against which the rope rests. Also, traction of each rope is based on frictional contact between the drive wheel and the rope.

Preferably, each rope passes around the diverting wheels and the drive wheel the wide side of the rope against the wheels. When there are several ropes, as illustrated, the ropes pass around the diverting wheels and the drive wheel adjacent each other in axial direction X of the drive wheel as well as adjacent each other in the width-direction w of the ropes, the wide side of each rope against the wheel in question.

Preferably, the rope comprises one or more continuous load bearing members extending in longitudinal direction of the rope throughout the length of the rope. Thus, the rope is provided with good load bearing ability for the rope.

Preferably, said load bearing member(s) is/are made of composite material comprising reinforcing fibers embedded in polymer matrix. The reinforcing fibers are preferably carbon fibers, but also other fibers can be used, such as glass fibers. Preferably, the rope is such that reinforcing fibers are distributed in the matrix substantially evenly. Also preferably, all the individual reinforcing fibers of the load bearing member are bound to each other by the matrix.

Preferably, said load bearing member(s) is/are parallel with the longitudinal direction of the rope. Thereby, it/they provide excellent longitudinal stiffness for the rope. The reinforcing fibers are also preferably parallel with the longitudinal direction of the rope, which facilitates further the longitudinal stiffness of the rope.

Preferably, said load bearing member(s) is/are embedded in elastic coating forming the surface of the rope. Thus, the rope is provided with a surface via which the rope can effectively engage frictionally with the cambered wheels and the drive wheel in terms of axial position control as well as traction. Thus, it is also possible to isolate load bearing members of each rope from each other in case there are several of them. The coating is particularly preferable in case where the load bearing member(s) is/are made of composite as defined, because thus the fragile and slippery load bearing member(s) are provided with protection as well as friction properties adjustable to perform well in terms of traction as well as axial position control.

The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
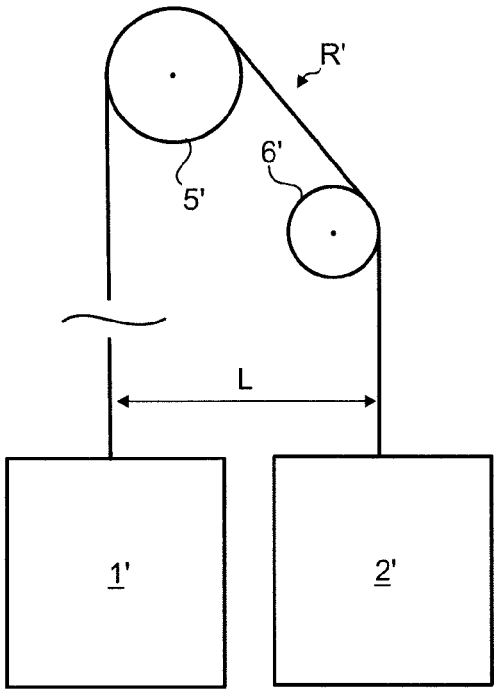
Fig. 1 Prior Art
FIG. 1 illustrates schematically an elevator according to prior art as viewed from the side.

FIG. 1 illustrates schematically an elevator according to prior art and has been described above in the application. In FIG. 1, reference numbers 1', 2', 5',6' R', L refer the first elevator unit, the second elevator unit, drive wheel, diverting wheel, roping and rope-to-rope distance, respectfully.

Figure 2:
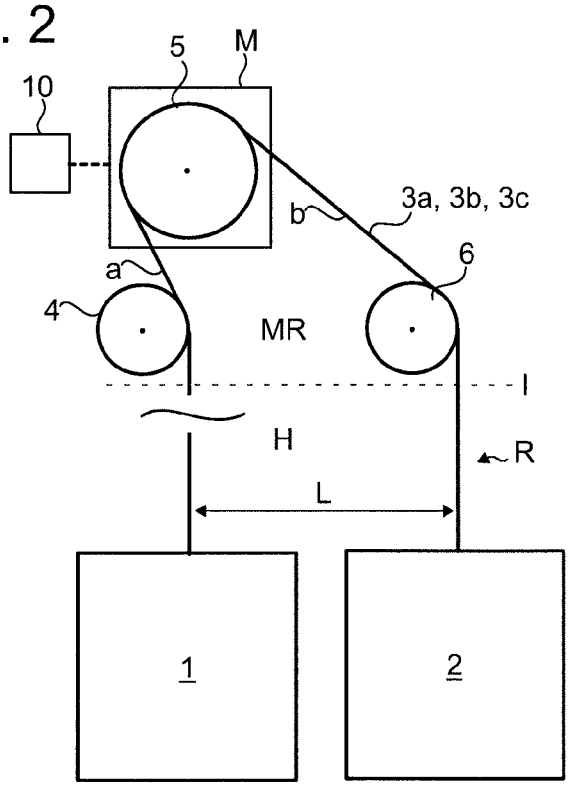
FIG. 2 illustrates schematically an elevator according to a first embodiment of the invention as viewed from the side.
Figure 3:
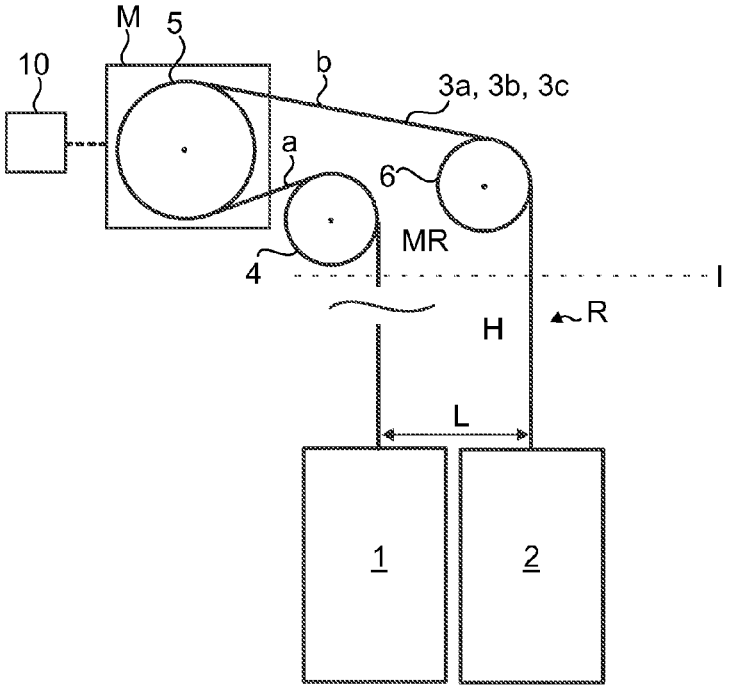
FIG. 3 illustrates schematically an elevator according to a second embodiment of the invention as viewed from the side.
Figure 4:
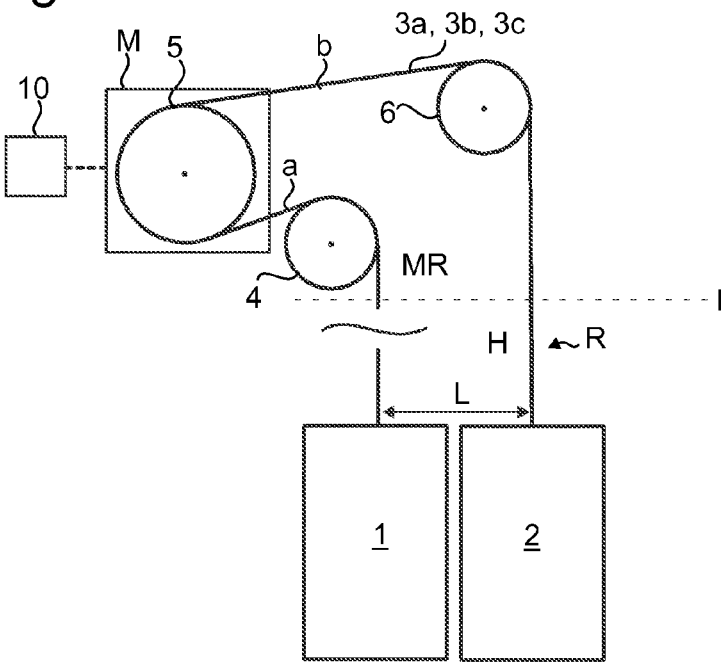
FIG. 4 illustrates schematically an elevator according to a third embodiment of the invention as viewed from the side.

FIGS. 2, 3 and 4 each illustrate an elevator according to a preferred embodiment of the invention. The elevator comprises a hoistway H and a first elevator unit 1 vertically movable in the hoistway H and a second elevator unit 2 vertically movable in the hoistway H. The elevator further comprises a suspension roping R comprising one or more belt-shaped suspension ropes 3*a*,3*b*,3*c* each interconnecting the first elevator unit 1 and the second elevator unit 2 and passing around wheels 4,5,6 comprising a drive wheel 5 for moving said one or more belt-shaped suspension ropes 3*a*,3*b*,3*c*. The two elevator units 1,2 form a balancing weight for each other by affecting each other via said one or more ropes whereby they are economical to move. At least one of these elevator units is an elevator car, wherein the elevator can transport passengers and/or goods. The other of these elevator units is preferably a counterweight, as in conventional elevators, but could alternatively be a second elevator car whereby two cars would form a balancing weight for each other. For providing force for moving the one or more suspension ropes 3*a*,3*b*,3*c* and thereby also for the elevator units 1,2, the elevator comprises a power source, in particular a motor M, arranged to rotate the drive wheel 5 engaging the one or more suspension ropes 3*a*,3*b*,3*c*. The elevator further comprises an automatic elevator control 10 arranged to control the motor M, whereby movement of the elevator units is automatically controllable.

Figure 5:
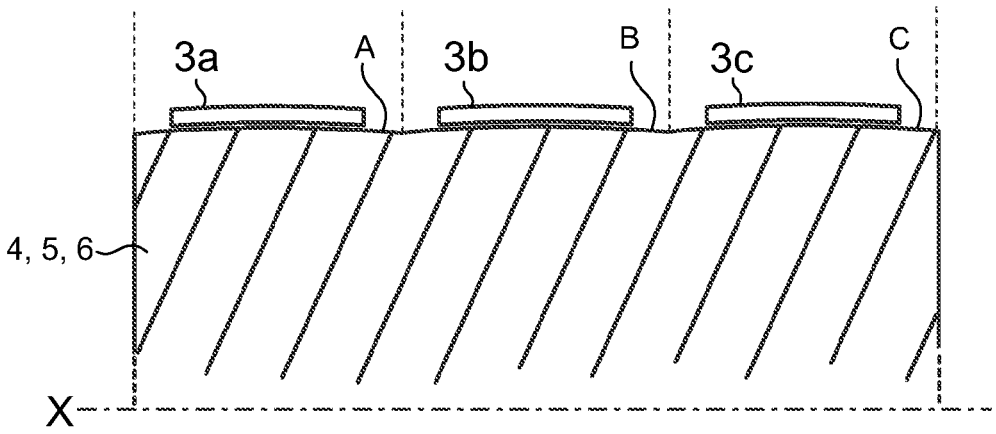
FIG. 5 illustrates schematically a cross section of the wheels of FIG. 2, 3 or 4.

In addition to said drive wheel 5, said wheels 4,5,6 further comprise a plurality of cambered diverting wheels 4, 6. Passage of the ropes around said wheels 4,5,6 is illustrated in FIG. 5 showing a cross sectional view of the ropes as they are positioned against each wheel. The drive wheel 5 is in this embodiment also cambered in the same way as the diverting wheels 4,6. The cambered diverting wheels 4,6 comprise a cambered circumferential surface area A,B,C for each of said one or more ropes 3*a*,3*b*,3*c* against which circumferential surface area A,B,C the rope in question is arranged to rest. In this way the axial position, i.e. the position of the belt-shaped ropes in axial direction X of the wheel 4,5,6 around which is passes, is controlled. In these embodiments, each cambered circumferential surface area A,B,C has a convex shape against the peak of which the rope rests. The cambered shape tends to keep the rope passing around it positioned resting against the peak thereof, thereby resisting displacement of the rope 3*a*,3*b*,3*c* away from this position in said axial direction X.

Said one or more belt-shaped suspension ropes 3*a*,3*b*,3*c* each comprise consecutive rope sections, namely a first rope section a extending between the drive wheel 5 and the first elevator unit 1, and a second rope section b extending between the drive wheel 5 and the second elevator unit 2. Both rope sections a, b diverge from the drive wheel 5 towards the same lateral side thereof (towards right in FIGS. 2 to 4), the first rope section a passing over a first cambered diverting wheel 4, in particular resting against a cambered circumferential surface area A,B,C thereof, and therefrom straight down to the first elevator unit 1, and the second rope section b passing over a second cambered diverting wheel 6, in particular resting against cambered circumferential surface area A,B,C thereof, and therefrom straight down to the second elevator unit 2.

The rope extending between the first elevator unit 1 and the second elevator unit passes around the first cambered diverting wheel 4, a drive wheel 5, and a second cambered diverting wheel 6, in this order, whereby with any of the two running directions each of said ropes is before arriving to the drive wheel 5 controlled in terms of its position in axial direction. The drive wheel 5 and the diverting wheels 4,6 being positioned such relative to each other that the rope sections a,b of a rope diverge from the drive wheel 5 towards the same lateral side thereof, the contact length between rope and the diverter wheel is with any rope-to-rope distance L adequately long to enable the cambered shape of the one of the diverting wheels 4,6, wherefrom the rope arrives to the drive wheel 5, to act effectively on the rope 3*a*,3*b*,3*c*.

In the embodiment illustrated in FIG. 2, the first rope section a diverges from the drive wheel 5 obliquely downwards to the first diverting wheel 4, and the second rope section b diverges from the drive wheel 5 obliquely downwards to the second diverting wheel 6. Thus, a contact length between the ropes and the drive wheel 5 can be kept adequate for most elevators. This facilitates also the overall slimness of the configuration of wheels 4,5,6.

In the embodiment illustrated in FIG. 3, both the first diverting wheel 4 and the second diverting wheel 6 are completely at lateral side of the drive wheel 5. In this embodiment, the first rope section a diverges from the drive wheel 5 obliquely upwards to the first diverting wheel 4, and the second rope section b diverges from the drive wheel 5 obliquely downwards to the second diverting wheel 6. Thus, the contact length between the ropes and the diverting wheel 4 is strongly increased thereby increasing the effect of the cambered shape of the diverting wheel 4 on the rope. In particular, the diverting wheel 4 diverts the angle of the ropes, i.e. the angle of the first rope section 1, substantially more than 90 degrees. Thus, the contact length between the ropes and the diverting wheel in question is strongly increased thereby increasing the effect of the cambered shape of the diverting wheel on the rope. With this configuration, also a contact length between the ropes and the drive wheel 5 is increased. In particular, the drive wheel 5 diverts the angle of the ropes substantially more than 180 degrees. A this long contact length ensures good traction between the ropes and the drive wheel 5. This kind of configuration also facilitates making the overall structure for the configuration of wheels 4,5,6 low. FIG. 3 shows an elevator with small distance L. Particularly, the distance L (rope-to-rope distance) between the first rope section a passing down from the first cambered diverting wheel 4 to the first elevator unit 1 and the second rope section b passing down from the second cambered diverting wheel 6 to the second elevator unit 2 is small, in particular 1.5 times the diameter of the drive wheel 5 or even less. Distances this short have caused problems when using cambered wheels for position control of ropes. A distance this short can also be achieved with the solution of FIG. 2 although not illustrated.

In the embodiment illustrated in FIG. 4, both the first diverting wheel 4 and the second cambered diverting wheel 6 are completely at lateral side of the drive wheel 5. In this embodiment, the first rope section a diverges from the drive wheel 5 obliquely upwards to the first diverting wheel 4, and the second rope section b diverges from the drive wheel 5 obliquely upwards to the second diverting wheel 6. Thus, the contact length between the ropes and the diverting wheels 4,6 is strongly increased thereby increasing the effect of the cambered shape of the diverting wheels 4,6 on the ropes 3*a*,3*b*,3*c*. In this case, each cambered diverting wheel 4,6 diverts the angle of the ropes, i.e. the angle of the first and second rope section respectively, substantially more than 90 degrees. Thus, the contact length between the ropes and the diverting wheel in question is strongly increased thereby increasing the effect of the cambered shape of the diverting wheel on the rope, which is adequate to ensure proper control of rope position in axial direction of the cambered diverting wheel. With this configuration, it is ensured the ropes arrive in proper axial position to the drive wheel 5 with any running direction. This kind of configuration also facilitates making the overall structure for the configuration of wheels 4,5,6 low. FIG. 4 shows an elevator with small distance L. Particularly, the distance L (rope-to-rope distance) between the first rope section a passing down from the first cambered diverting wheel 4 to the first elevator unit 1 and the second rope section b passing down from the second cambered diverting wheel 6 to the second elevator unit 2 is small, in particular 1.5 times the diameter of the drive wheel 5 or even less.

In general, it is possible that said one or more belt-shaped suspension ropes 3*a*,3*b*,3*c* comprises only one of these ropes arranged as defined, but preferably said one or more belt-shaped suspension ropes comprises plurality of belt-shaped suspension ropes arranged as defined. In the embodiment illustrated in FIGS. 2 to 4 there are three of belt-shaped suspension ropes arranged as defined.

The ropes being belt-shaped they have two oppositely facing wide sides (which face in FIGS. 2 to 4 upwards and downwards), as well as lateral flanks (which face in FIGS. 2 to 4 left and right). Each rope 3*a*,3*b*,3*c* passes around the diverting wheels 4,6 and the drive wheel 5 the wide side of the rope against the wheel in question. When there are several ropes, as illustrated, the ropes 3*a*,3*b*,3*c* pass around the diverting wheels 4,6 and the drive wheel 5 adjacent each other in axial direction X of the drive wheel 5 as well as adjacent each other in the width-direction w of the ropes, the wide sides of each rope 3*a*,3*b*,3*c* against the wheel in question.

Preferably, the circumferential surface area A,B,C as well as the surface of the rope via which the rope rest against the circumferential surface area A,B,C in question are both smooth such that neither of said circumferential surface area A,B,C nor the rope has protrusions extending into recesses of the other. Thereby, the control of axial position of each rope is provided by the shape of the cambered circumferential surface area A,B,C against which the rope rests. Also, traction of each rope is based on frictional contact between the drive wheel 5 and the rope. Therefore, said circumferential surface area nor the rope surface need not be configured for engaging to each other via a polyvee- or toothed engagement.

It is preferable that said first cambered diverting wheel 4, said drive wheel 5, and said second cambered diverting wheel 6 are mounted to rotate at a stationary location above the elevator units 1, 2, as illustrated in FIGS. 2, 3 and 4.

It is preferable, that the elevator is installed in a building. The, preferably said first cambered diverting wheel 4, said drive wheel 5, and said second cambered diverting 6 wheel are mounted on stationary structure(s) of the building, such as on structures of the hoistway H or structures of a machine room MR provided close to, such as above or next to the hoistway H. In FIGS. 2 to 4, the machine room MR is above the common hoistway H, where the elevator units 1 and 2 travel. Dashed line I represents the floor line of the machine room MR. It is of course obvious, that the elevator could alternatively be implemented without a machine room and/or such that the elevator units travel in different hoistways.

It is preferable, that each of said one or more ropes 3*a*,3*b*,3*c* comprises one or more continuous load bearing members 20, which load bearing members 20 extending in longitudinal direction of the rope 3*a*,3*b*,3*c* throughout the length of the rope 3*a*,3*b*,3*c*, which load bearing member(s) 20 is/are made of composite material comprising reinforcing fibers f embedded in polymer matrix m. Said fibers f are preferably carbon fibers. Preferably, the one or more continuous load bearing members 20 is/are embedded in elastic coating forming the surface of the rope. Thus, the rope is provided with a surface via which the rope can effectively engage frictionally with the cambered wheels and the drive wheel in terms of axial position control as well as traction. Further preferred details of the rope 3*a*,3*b*,3*c* will be later described in context of description of FIG. 6.

Figure 6:
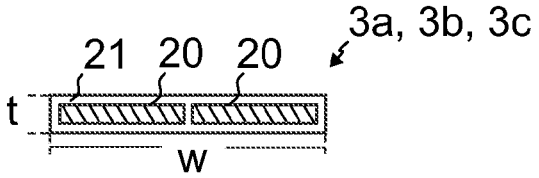
FIG. 6 illustrates the cross section of a preferred structure for an individual rope.

FIG. 6 illustrates the cross section of a preferred structure for an individual rope 3*a*,3*b*,3*c*. The rope 3*a*,3*b*,3*c* is in the form of a belt, and thereby has a width w substantially larger than the thickness t thereof. This makes it well suitable for elevator use as bending of the rope is necessary in most elevators. The rope 3*a*,3*b*,3*c* comprises continuous load bearing members 20 extending in longitudinal direction of the rope 3*a*,3*b*,3*c* throughout the length of the rope 3*a*,3*b*,3*c*. The number of load bearing members 20 comprised in the rope 3*a*,3*b*,3*c* can alternatively be also greater or smaller than the two shown in FIG. 6. Each of the load bearing member(s) 20 is parallel with the longitudinal direction of the rope 3*a*,3*b*,3*c* whereby excellent longitudinal stiffness for the rope 3*a*,3*b*,3*c* is provided. The fibers f preferably are continuous fibers, in particular fibers continuous throughout the length of the rope 3*a*,3*b*,3*c*. So as to provide the rope 3*a*,3*b*,3*c* with a turning radius well suitable for elevator use, it is preferable that the width/thickness ratio of the rope is substantial, in particular more than 2, preferably more than 4 as illustrated. Thus, reasonable bending radius can be achieved for the rope 3*a*,3*b*,3*c* when it contains substantially material of high bending rigidity, such as fiber reinforced composite material.

The load bearing members 20 are preferably embedded in an elastic coating 21 forming the surface of the rope 3*a*,3*b*, 3*c*, as illustrated. The coating 21 is preferably made of elastomer. In general, the elastic coating 21 provides the rope 3*a*,3*b*,3*c* good wear resistance, protection, and isolates the load bearing members 20 from each other. The elastic coating 20 also provides the rope high friction, for instance for frictional traction contact with a rotatable drive wheel 5 as illustrated in FIG. 2, 3 or 4. The elastomer is preferably polyurethane, which provides best results in terms of traction and durability in elevator use.

Figure 7:
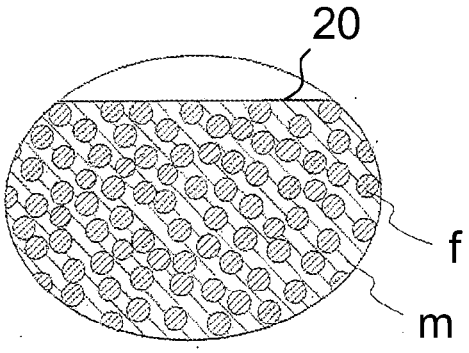
FIG. 7 illustrates inside the circle a partial and enlarged cross-section of the load bearing member of FIG. 6.

Preferably, each of said load bearing members 20 is made of composite material comprising reinforcing fibers f embedded in polymer matrix m. FIG. 7 illustrates inside the circle a partial and enlarged cross-section of the load bearing member 20 of the rope 3*a*,3*b*,3*c*. The material provides the rope 3*a*,3*b*,3*c* excellent longitudinal stiffness and low weight, which are among preferred properties for an elevator. The reinforcing fibers f are most preferably carbon fibers, which are most advantageous in terms of longitudinal stiffness as well as weight.

To reduce buckling of fibers and to facilitate a small bending radius of the rope, among other things, it is therefore preferred that the polymer matrix is hard, and in particular non-elastomeric. The most preferred materials are epoxy resin, polyester, phenolic plastic or vinyl ester. The matrix of the load bearing member 20 is preferably such that the module of elasticity E of the polymer matrix is over 2 GPa, most preferably over 2.5 GPa, yet more preferably in the range 2.5-10 GPa, most preferably of all in the range 2.5-3.5 GPa. The structure is advantageous as hereby the service life of the rope can be extended.

The composite material is preferably such that the individual reinforcing fibers are parallel with the length direction of the rope. Thus, they provide excellent longitudinal stiffness for the rope. The individual reinforcing fibers are preferably distributed in the matrix substantially evenly, such that substantially all the individual reinforcing fibers of the load bearing member are bound to each other by the matrix. The rope 3*a*,3*b*,3*c* is preferably in accordance with any one of the composite ropes disclosed in international patent application WO2009090299A1.

It is preferable, that the rope sections a,b diverge radially from the drive wheel as illustrated, preferably each rope section a,b extending all the way to its elevator unit 1,2 such that they are on the same plane. Particularly, it is preferable that the whole length of each of said ropes passes along one and same vertical plane. Each rope may be connected to the elevator units by its ends (as shown in FIGS. 2 to 4; i.e. with 1:1 suspension ratio) or via diverting wheels mounted on the elevator unit (not shown; e.g. with 2:1 suspension ratio).

In the above, different directions in which the rope sections diverge from the drive wheel have been discussed. As an alternative, it is apparent that one or both of first and second rope sections could diverge horizontally instead of what is shown. It is also apparent that the ropes may diverge in any combination of the directions illustrated or mentioned herein.

It is to be understood that the above description and the accompanying Figures are only intended to illustrate the present invention. It will be apparent to a person skilled in the art that the inventive concept can be implemented in various ways. For example, the belt-shaped rope can have an internal structure or surface different from what has been presented as preferred. The invention and its embodiments are not limited to the examples described above but may vary within the scope of the claims.

The invention claimed is:

1. An elevator comprising:

a first elevator unit vertically movable in a hoistway;

a second elevator unit vertically movable in the hoistway;

a suspension roping comprising one or more belt-shaped suspension ropes interconnecting the first elevator unit and the second elevator unit;

a drive wheel for moving said one or more belt-shaped suspension ropes, wherein the drive wheel has a first side and second side opposite to the first side; and a plurality of cambered diverting wheels, wherein each of the cambered diverting wheels are cambered in a direction perpendicular to a radial direction of the respective cambered diverting wheel;

said one or more belt-shaped suspension ropes each passing around the drive wheel and comprising consecutively:

a first rope section extending between the drive wheel and the first elevator unit; and a second rope section extending between the drive wheel and the second elevator unit, wherein both rope sections diverge from the drive wheel towards the first side of the drive wheel, the first rope section passing over a first cambered diverting wheel, and resting against a cambered circumferential surface area thereof, and therefrom down to the first elevator unit, and the second rope section passing over a second cambered diverting wheel, and resting against a cambered circumferential surface area thereof, and therefrom down to the second elevator unit, wherein the drive wheel and the plurality of cambered diverting wheels are located above the first and second elevator units, wherein the first elevator unit and the second elevator unit are spaced apart in a width direction, wherein the first rope section and the second rope section are continuously separated in said width direction from a point at which they diverge from the drive wheel towards the first and second elevator units, respectively, and wherein the first rope section diverges from the drive wheel obliquely downwards with respect to the hoistway to the first cambered diverting wheel, and the second rope section diverges from the drive wheel obliquely downwards with respect to the hoistway to the second cambered diverting wheel.

2. The elevator according to claim 1, wherein the drive wheel comprises a drive wheel circumferential surface area that is cambered, for each of said one or more ropes against which the ropes are arranged to rest.

3. The elevator according to claim 1, wherein one of the elevator units comprises an elevator car and the second comprises a counterweight or a second elevator car.

4. The elevator according to claim 1, wherein each of said one or more ropes comprises one or more continuous load bearing members extending in longitudinal direction of the rope throughout the length of the rope, which load bearing member(s) is/are made of composite material comprising reinforcing fibers embedded in polymer matrix.

5. The elevator according to claim 1, wherein each of said one or more ropes comprises one or more continuous load bearing members extending in longitudinal direction of the rope throughout the length of the rope, which load bearing member(s) is/are embedded in elastic coating forming the surface of the rope.

6. The elevator according to claim 1, wherein each cambered circumferential surface area as well as the surface of the rope resting against it are smooth.

7. The elevator according to claim 1, wherein each rope passes around the diverting wheels and around the drive wheel, with a wide side of each rope located on the diverting wheels and the drive wheel.

8. The elevator according to claim 1, further comprising a machine room housing the drive wheel and the plurality of cambered diverting wheels, wherein the machine room is located above the hoistway.

* * * * *